US005603421A

United States Patent [19]

Opresco

[11] Patent Number: 5,603,421

[45] Date of Patent: Feb. 18, 1997

[54] TWO-FINGER CHILD RESISTANT CLOSURE

[75] Inventor: Ovidiu Opresco, New York, N.Y.

[73] Assignee: Weatherchem Corporation, Twinsburg, Ohio

[21] Appl. No.: 513,453

[22] Filed: Aug. 10, 1995

[51] Int. Cl.[6] ..... B65D 50/04

[52] U.S. Cl. ..... 215/217; 215/220; 215/330

[58] Field of Search ..... 215/209, 216, 215/217, 221, 330, 218, 219, 220, 223; 220/281

[56] References Cited

U.S. PATENT DOCUMENTS

| | | | |
|---|---|---|---|
| 3,399,796 | 9/1968 | Steiner | 215/9 |
| 3,612,323 | 10/1971 | Malick | 215/216 X |
| 3,698,584 | 10/1972 | Miller | 215/9 |
| 3,826,395 | 7/1974 | Montgomery | 215/9 |
| 3,831,797 | 8/1974 | Stevens, Jr. | 215/9 |
| 3,841,514 | 10/1974 | Montgomery et al. | 215/9 |
| 3,895,730 | 7/1975 | Koehne et al. | 215/216 |
| 4,172,533 | 10/1979 | Montgomery | 215/216 |
| 4,326,649 | 4/1982 | Marino et al. | 220/281 X |
| 4,401,225 | 8/1983 | Schwaikert | 220/281 X |
| 4,413,742 | 11/1983 | Sandhaus | 215/216 |
| 4,479,585 | 10/1984 | Sandhaus | 215/216 X |
| 4,500,006 | 2/1985 | Lafortune et al. | 220/218 X |
| 4,687,112 | 8/1987 | Swartzbaugh | 215/216 |
| 4,752,013 | 6/1988 | Miller et al. | 215/216 |
| 4,752,014 | 6/1988 | House et al. | 215/216 |
| 5,449,077 | 9/1995 | Seidler | 215/216 |

*Primary Examiner*—Gary E. Elkins
*Assistant Examiner*—Nathan Newhouse
*Attorney, Agent, or Firm*—Pearne, Gordon, McCoy & Granger

[57] ABSTRACT

A closure cap has winged fingerpieces which include latching members. The fingerpieces provide a hinge-up release movement of the latching members when the fingerpieces are squeezed radially inwardly. The invention provides a closure that is child resistant yet easy and convenient for an adult to operate.

5 Claims, 3 Drawing Sheets

TWO-FINGER CHILD RESISTANT CLOSURE

FIELD OF THE INVENTION

This invention relates to child-resistant closures, and particularly to child-resistant threaded caps for closing plastic or glass bottles or similar containers.

PRIOR ART

It is known to provide latching elements on caps which prevent cap rotation and removal until the cap is manipulated in a certain way that is non-intuitive for a child, or is beyond a child's strength.

Various proposals have been made to accomplish this general objective. In one class of devices, the cap is opened by squeezing the cap from opposite sides to distort the cap into an oval configuration and thereby radially release locking elements at 90 degrees spacing from the points being squeezed. Examples are found in the following U.S. patents: Steiner U.S. Pat. No. 3,399,796, Montgomery U.S. Pat. No. 3,826,395, Montgomery et al. U.S. Pat. No. 3,841,514, and Montgomery U.S. Pat. No. 4,172,533.

In another class of devices, a cap skirt is pushed upwardly for release of the cap. Examples are found in the following U.S. patents: Miller U.S. Pat. No. 3,698,584 and Stevens, Jr. U.S. Pat. No. 3,831,797, In still another class of devices, a lock or projection is deflected radially outwardly for release by pressure on an adjacent area. An example is shown in Swartzbaugh U.S. Pat. No. 4,687,112.

BRIEF DESCRIPTION OF THE INVENTION

The invention provides a closure cap in which a hinge-up release movement of latch or lock elements occurs when related parts are squeezed radially inwardly by a pincer-like movement of two opposed fingers of the hand, such as the thumb and second or third finger. The invention provides a closure that is child resistant yet easy and convenient for an adult to operate. The closure of the invention may be embodied in an aesthetically pleasing design, unlike designs of the prior art which involve awkward projections, exposed linkages or similar unsightly features.

DETAILED DESCRIPTION OF THE INVENTION

Figure 1:
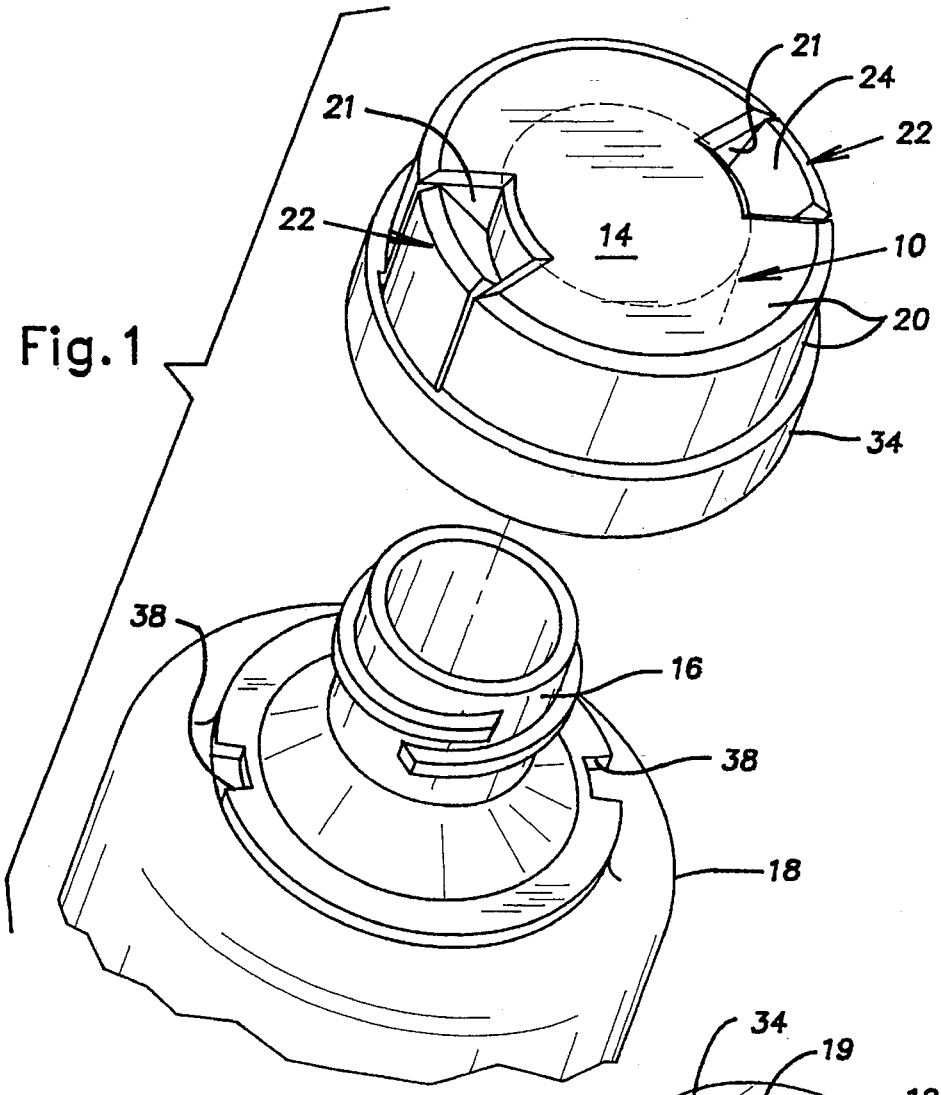
FIG. 1 is an isometric view of a cap and container combination embodying the invention, the container being partly broken away.
Figure 2:
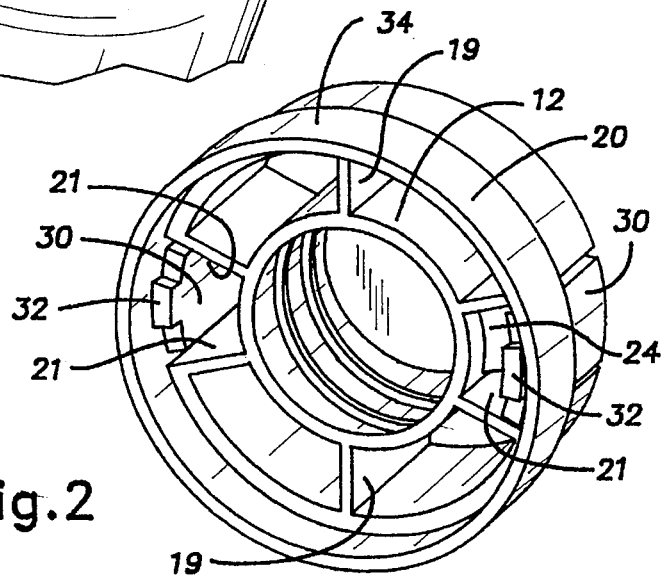
FIG.2 is an isometric view of the underside of the cap seen in FIG. 1.
Figure 5:
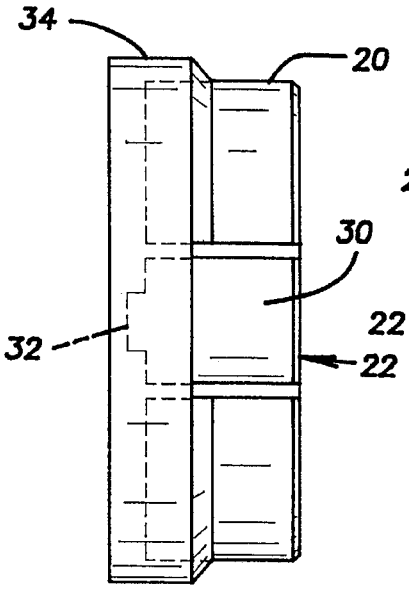
FIG. 5 is a side elevation of the cap.
Figure 3:
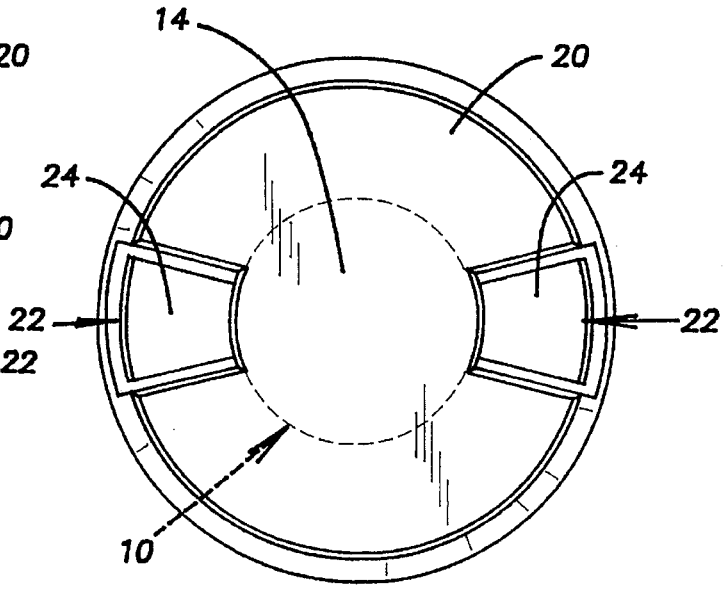
FIG. 3 is a top plan view of the cap.
Figure 4:
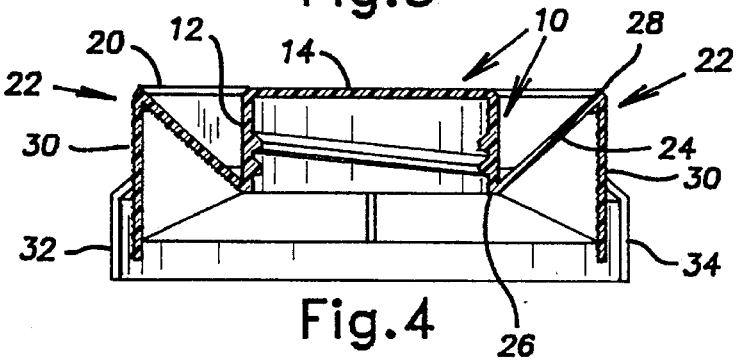
FIG. 4 is a cross-sectional view of the cap in elevation.
Figure 6:
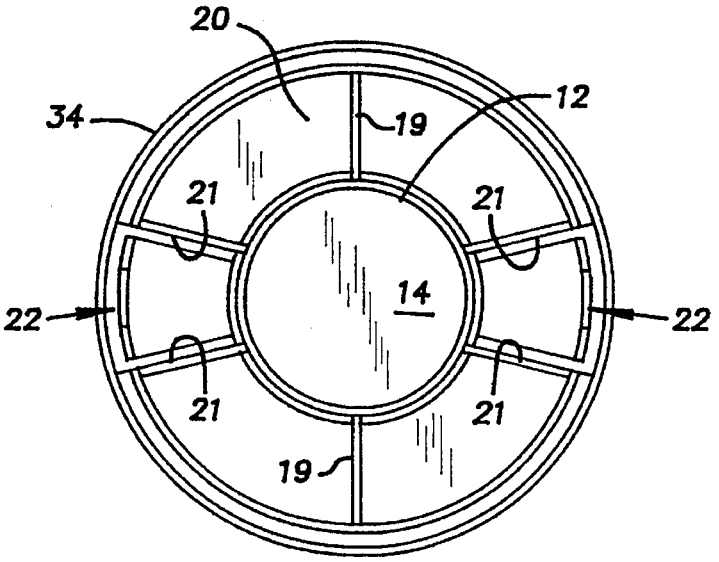
FIG. 6 is a bottom plan view of the cap.

A child resistant closure or cap system embodying the invention is shown in the drawings. The cap includes a cap body or cap proper 10 surrounded by a faux cap portion 20 which is integrally formed with the cap body 10. The cap body includes a skirt 12 and a top wall 14 adapted to close the mouth of an associated container 18.

The faux cap portion 20 of the closure is annularly interrupted at two diametrically opposed locations to form a pair of recesses which are preferably formed so as to include sidewalls 21 which serve both the reinforce the faux cap portion and to provide closed sides to the recesses. The faux cap portion of the closure may be provided with reinforcing walls 19 in addition to the walls 21.

A winged fingerpiece 22 is positioned in each of the recesses. Each winged fingerpiece comprises a lever member 24 integral with the cap body and hinged at a substantially horizontal first hinge to the cap body skirt 12 at a location spaced down from the top wall 14.

Figure 7:
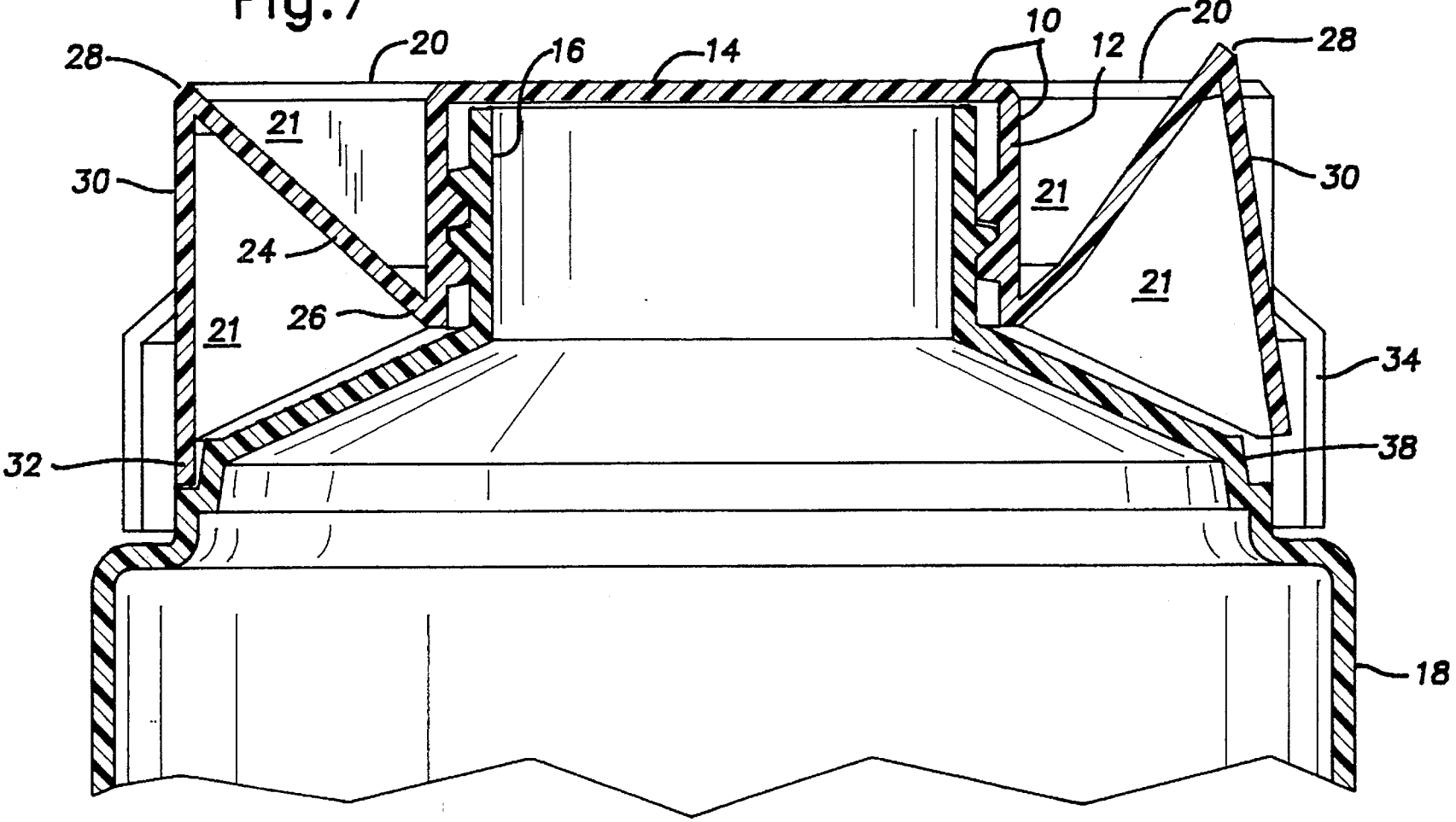
FIG. 7 is a cross-sectional view on an enlarged scale of the cap and associated container in elevation, and partly broken away.

Each lever member 24 extends upward and radially outward from the first hinge to a distal end 28 which is normally in the position shown in all the drawings except the right side of FIG. 7. In this normal or latching position, each distal end 28 is at a given radial distance from the center of the cap.

Each winged fingerpiece further comprises a latch member 30 which is formed integrally with and hinged to the distal end 28 of its associated lever member 24 at a substantially horizontal second hinge which is formed at the distal end of the lever and which may therefore be referred to, by the same reference numeral, as the hinge 28.

Each latch member 30 depends downward from its associated hinge 28 and may terminate in a latch detent or tab 32. The container may be provided with keepers or notches 38 in the vicinity of the container neck 16 for receiving the latch detents 32 when the closure is on the container and the latch member is in its normal or latching position. In this condition, each latch detent is in interfering relationship with its keeper and relative rotation between the cap and the container is prevented.

When lateral finger pressure is applied to the distal ends 28, either directly or through finger engagement with lower portions of the latch members 30, the lever members 24 are yieldingly displaceable to a second position or unlatching position wherein their distal ends 28 are closer to the center of the cap and higher than they were in the first or latching position, as may be seen in the right hand portion of FIG. 7. The upward movement of the distal ends 28 draws the latch members upward from their latching position to their unlatching position so that the detents 32 come free of the keepers 38 and the cap may be backed off or and unthreaded from the container neck 16. In the case of a threaded closure, as shown, the threads may be sufficiently steep so that the first half turn of the lid raises the detents above engagement with the keepers even in the relaxed condition of the parts. Thus, squeezing of the fingerpieces is required only at the very start of removal of the cap.

When the container is to be re-closed, and the cap is turned down on the container neck, the latch members preferably remain clear of the keepers until the end of the final half turn of the cap, at which point the detents 32 snap into engagement with the keepers to secure the cap in child-resistant closed position.

A guard skirt 34 may be molded integrally with the other parts of the cap. It has a conical portion which tapers downwardly and outwardly from its line of joinder with the outside of the interrupted skirt portion of the faux cap 20, and then a cylindrical portion which preferably extends down to a level just clear of the shoulder of the container, as seen in FIG. 7. The guard skirt is not interrupted except at its tapered or conical portion, and its cylindrical portion bridges the recesses in which the winged fingerpieces 22 are positioned. The guard skirt protects the latch members 30 and restrains them against lateral spreading as they move between latching and unlatching position and also dresses the closure to make it of more pleasing appearance.

Many modifications may be made in the illustrated exemplary embodiment of the invention. For example, the guard skirt 34 may be omitted, or it may be joined in a separate and later operation. The parts may be formed so that in their fully relaxed state the latch members 30 spread beyond the inside radius of the guard skirt, so that a constraining action of the guard skirt then applies to the parts even in their latching position since they must be biased or sprung even to reach such position, such bias being of course increased as the parts are moved to unlatching position. Accordingly, the invention is not limited to the precise details of the disclosed example, and is to be determined by proper interpretation of the following claims.

What is claimed is:

1. A child resistant closure cap comprising a cap body having a skirt adapted to threadedly engage the neck of a container and a top wall adapted to close the mouth of said container, a faux cap portion surrounding the cap body and being formed integrally therewith, said faux cap portion being annularly interrupted at two diametrically opposed locations to form a pair of recesses, a pair of fingerpieces each positioned in one of said recesses and each comprising a lever member integral with said cap body and hinged at a substantially horizontal hinge to said cap body skirt at a location thereon spaced down from said top wall, each said lever member having a portion extending upward to an elevation adjacent said top wall from said hinge line and a portion extending downward from said elevation to a distal end which is normally disposed at a first position which is a given radial distance from the center of the cap, each of said fingerpieces further comprising a latch member connected to its associated lever member and depending downwardly therefrom, said distal ends of said lever members being squeezable toward each other to cause said lever members to pivot and said distal ends to move radially inwardly to thereby draw said latch members upwardly along the axial direction to release said latch members.

2. A cap as in claim 1, the latch members of said fingerpieces being surrounded by a guard skirt formed integrally with said faux cap portion.

3. A cap as in claim 2, said guard skirt having a greater radius than does said faux cap portion.

4. A cap as in claim 2, the latch members being surrounded by said guard skirt when said lever members are squeezed toward each other to release said latch members.

5. A cap as in claim 1, combined with a container, said skirt of said cap body including threads, the container including a threaded neck, and receivers on said neck for said latch members.

* * * * *